US005730106A

United States Patent [19]

Gonzalez

[11] Patent Number: 5,730,106

[45] Date of Patent: Mar. 24, 1998

[54] FUEL/VAPOR SEPARATOR APPARATUS FOR DIESEL ENGINES

[76] Inventor: Jose M. Gonzalez, 263 Chestnut St., Kearny, N.J. 07032

[21] Appl. No.: 701,629

[22] Filed: Aug. 22, 1996

Related U.S. Application Data

[60] Provisional application No. 60/004,400, Sep. 27, 1995.

[51] Int. Cl.[6] ..... F02M 37/04

[52] U.S. Cl. ..... 123/516; 123/510

[58] Field of Search ..... 123/510, 516, 123/518, 519, 520, 521

[56] References Cited

U.S. PATENT DOCUMENTS

| | | | |
|---|---|---|---|
| 2,878,889 | 3/1959 | Gilbert | 123/516 |
| 4,024,848 | 5/1977 | Lee . | |
| 4,279,232 | 7/1981 | Schuster | 123/516 |
| 4,372,847 | 2/1983 | Lewis | 123/510 |
| 4,454,848 | 6/1984 | Duprez . | |
| 4,502,451 | 3/1985 | Duprez . | |
| 4,763,684 | 8/1988 | Kelch | 123/516 |
| 4,922,959 | 5/1990 | Sasaki | 123/516 |
| 4,981,584 | 1/1991 | Nunes . | |
| 5,095,880 | 3/1992 | Ricks | 123/516 |
| 5,103,793 | 4/1992 | Riese et al. . | |
| 5,137,002 | 8/1992 | Mahoney et al. . | |
| 5,253,628 | 10/1993 | Brown | 123/516 |
| 5,269,276 | 12/1993 | Brown . | |
| 5,355,860 | 10/1994 | Ekstam . | |
| 5,389,245 | 2/1995 | Jaeger et al. . | |
| 5,520,156 | 5/1996 | Brunnhofer . | |
| 5,579,740 | 12/1996 | Cotton | 123/516 |

FOREIGN PATENT DOCUMENTS

| | | | |
|---|---|---|---|
| 652622 | 3/1929 | France | 123/516 |
| 0210355 | 12/1989 | Japan | 123/516 |

*Primary Examiner*—Carl S. Miller
*Attorney, Agent, or Firm*—Plevy & Associates

[57] ABSTRACT

A fuel/vapor separator apparatus for de-vaporizing fuel entrained with vapor has a hollow canister defining a separation chamber. The canister has an input port for receiving the fuel entrained with vapor, an output port in communication with the engine for removal of the de-vapored fuel from the chamber, and a vapor port for removal of the released vapor from the chamber. A screen element is located in the separation chamber of the canister between the input port and the output port for agitating the fuel to release the vapor from the fuel. The apparatus has a valving arrangement for connecting the vapor port to the reservoir. The valving arrangement has at least three ports. The vapor port of the canister is in communication with the first port of the valving arrangement. The reservoir is in communication with the second port of the valving arrangement, and ambient air is in communication with the third port. The valving arrangement has a conduit with a control pin for selecting the venting of the separation chamber through the vapor port to either the fuel tank or the ambient air.

22 Claims, 8 Drawing Sheets

FUEL/VAPOR SEPARATOR APPARATUS FOR DIESEL ENGINES

This application claims the benefit of U.S. provisional application Ser. No. 60/004,400, filed Sep. 27, 1995.

FIELD OF THE INVENTION

The invention relates to an apparatus for separating vapor from fuel and more particularly to an apparatus for separating vapor from diesel fuel for use in a diesel engine.

BACKGROUND OF THE INVENTION

In producing mechanical power in an internal-combustion engine, both fuel and air are needed to create the combustion to form the expanding gas and the mechanical power. The fuel and air are mixed in an internal-combustion engine using a fuel injector or a carburetor. A fuel injector delivers fuel or a fuel-air mixture to the cylinders of the internal-combustion engine by means of pressure from a pump. The fuel or fuel-air mixture mixes with the air in the cylinder.

Modern day internal-combustion engines use computers to control the engine including the metering of fuel into the cylinders. While the computer can monitor various conditions of the engine, such as temperatures and pressures, not all properties of all elements and conditions can be monitored. Such elements that are typically not monitored are the properties of the fuel. The computer, therefore, is programmed that the fuel is of a standard quality including a minimum amount of air entrained in the fuel.

While the standard quality of the fuel is critical with gasoline internal-combustion engine, the amount of air entrained in the fuel is more critical with diesel engines. With diesel engines, the fuel is not mixed with air prior to being injected into the cylinder. The air that is mixed with the fuel is a known quantity determined by the volume of the cylinder. The diesel is controlled by the amount of fuel injected into the cylinder.

Another difference is that diesel engines bum a fuel oil (diesel fuel) instead of gasoline. Furthermore, diesel engines differ from gasoline engines in that the ignition of fuel is caused by compression of air in its cylinders instead of by a spark. Another area in which diesel engines differ from gasoline engines is that in conventional diesel only a portion of the fuel pumped to the engine is used, the excess fuel, which is entrained with air, is returned to the fuel tank.

It has been recognized that if air is entrained in the fuel prior to injection into the cylinder, the performance of the engine suffers. It has, therefore, been recognized that it is desirable to remove the air vapor from the fuel prior to the fuel injectors, so that when the fuel injector adds fuel to the cylinder there will not be too much air and too little fuel.

One prior art patent, Ekstam, U.S. Pat. No. 5,355,860, which recognizes the detriment in having air entrained in the fuel, discloses a system that has components for removing water and particles from the fuel in addition to the air. The air removal portion of the system has a vessel with an upper housing portion and a lower canister portion which is threadably connected to the upper housing. The lower canister receives a replaceable filter cartridge. The filter cartridge is connected to a threaded portion of a filter receiver that has a port or an aperture connected to the engine. In addition, the vessel has an overflow tube which is ported to the fuel tank.

Fuel enters the vessel through an inlet from a particle filter in this patent. The level of the fuel in the filter is above the replaceable filter cartridge. The fuel passes through the filter to a center passage on the way to the engine. The patent purports that air bubbles are retained on the outside surface of the filter and allowed to float up and away from the filter media. The bubbles are purported to float out of the overflow tube.

It would be desirable to effectively remove vapor from the fuel.

SUMMARY OF THE INVENTION

This present invention is directed to a fuel/vapor separator apparatus for de-vaporizing fuel entrained with vapor and returning the vapor to a reservoir. The apparatus has a hollow canister defining a separation chamber. The canister has an input port for receiving the fuel entrained with vapor, an output port in communication with the engine for removal of the de-vapored fuel from the chamber, and a vapor port for removal of the released vapor from the chamber. A screen element is located in the separation chamber of the canister between the input port and the output port for agitating the fuel to release the vapor from the fuel. The apparatus has a valving arrangement for connecting the vapor port to the reservoir.

The valving arrangement has at least three ports. The vapor port of the canister is in communication with the first port of the valving arrangement. The reservoir is in communication with the second port of the valving arrangement, and ambient air is in communication with the third port. The valving arrangement has a conduit with a control pin for selecting the venting of the separation chamber through the vapor port to either the fuel tank or ambient air.

In a preferred embodiment, the hollow canister has a second screen element located in the separation chamber between the screen element and the output port for limiting any foaming from reaching the output port.

One object, feature, and advantage resides in the screen element located in the separation chamber of the canister between the input port and the output port agitating the fuel to release the vapor from the fuel.

Another object, feature, and advantage resides in the valving arrangement of the fuel/vapor having a quadruplet of ports that permits a fuel cartridge to be easily and efficiently drained, without a significant loss of fuel.

An additional object, feature, and advantage resides in the ability to change a filter cartridge when the engine is running, if desired.

Moreover, an additional object, feature, and advantage resides in not being required to prime the fuel system after changing filters.

Further objects, features, and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawing forms which are presently preferred; it being understood, however, that this invention is not limited to the precise arrangements and instrumentalities shown.

DETAILED DESCRIPTION OF THE PREFERRED EMBODIMENTS

Figure 1:
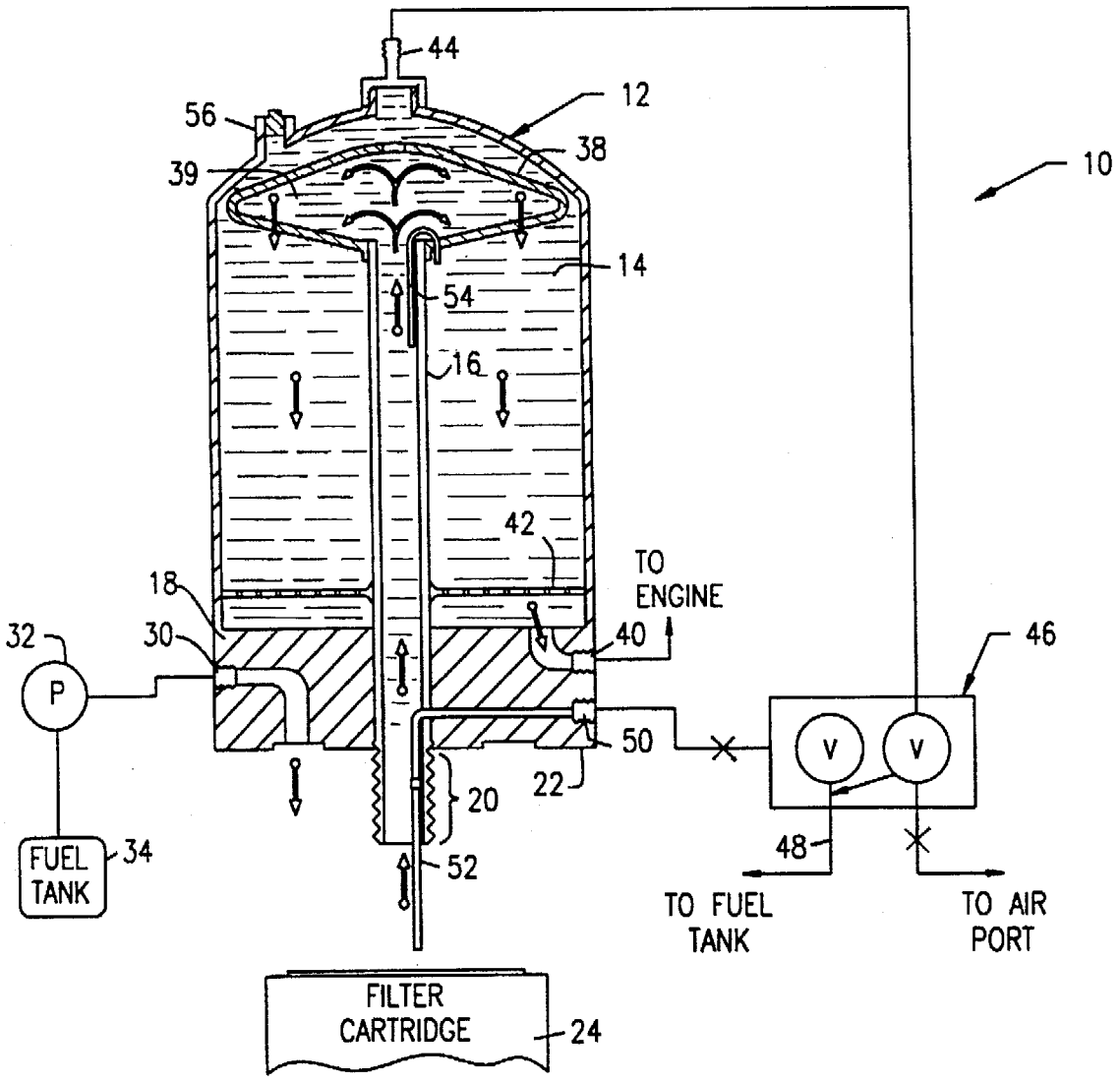
FIG. 1 is a sectional view of a hollow canister that defines a separation chamber according to the invention. A valving arrangement, a fuel filter cartridge, a fuel tank, and a fuel pump are shown schematically.

Referring now to the drawings, wherein like numerals indicate like elements and where prime (' and ") indicate(s) counterparts of such like elements, there is shown in FIG. 1 a fuel/vapor separator device in accordance with the present invention designated generally as 10.

The fuel/vapor separator apparatus 10, shown in FIG. 1, includes a hollow canister 12 that defines a separation chamber 14. A supply tube 16 extends through the base 18 of the canister 12 and terminates at a point near the top of the separation chamber 14. The bottom section 20 of the supply tube 16 is threaded and extends down below the bottom surface 22 of the canister base 18. The threaded bottom section 20 of the supply tube 16 is adapted to engage a fuel filter cartridge 24, wherein the fuel filter cartridge 24 is held in place by the threaded bottom section 20 of the supply tube 16 and seats against the bottom surface 22 of the canister base 18. Fuel filter cartridges for diesel fuel engines are well known in the art. Any such fuel filter cartridge of the proper size and specification can be used in conjunction with the present invention.

A supply port 30 is formed in the canister base 18. The supply port 30 is connected to the fuel pump 32 and receives a flow of fuel from the fuel tank, or a reservoir, 34. The supply port 30 directs the flow of fuel into the fuel filter cartridge 24. The fuel filter cartridge 24 filters the fuel in the traditional manner and directs the filtered fuel into the supply tube 16. The filtered fuel travels through the supply tube 16 and is expelled from the open top end of the supply tube 16 near the top of the separation chamber 14. In normal operation of a preferred embodiment, the separation chamber 14 is completely filled with fuel. The apparatus 10 typically rims in a range of 14 to 60 pounds per square inch (psi). The temperature of the apparatus 10 is dependent on several factors including ambient temperature, and the type of diesel engine to which the apparatus is connected.

An upper metal screen element 38 is attached to the supply tube 16 near the top of the separation chamber 14. In a preferred embodiment, the screen element 38 forms an inner enclosed area 39 bounded by a pair of frustum of cones with the bases joined. As the filtered fuel leaves the supply tube 16, gravity pulls the fuel through the upper metal screen element 38. The passage of the fuel through the metal screen element 38 agitates the fuel and helps to break the surface tension of the fuel, thereby enabling air and vapor bubbles to leave the liquid fuel. The word agitate is used here to mean upset or disturb the fuel or cause the fuel to move with violence or sudden force; the elements of the apparatus located in the separation chamber 14 do not move themselves.

Figure 3:
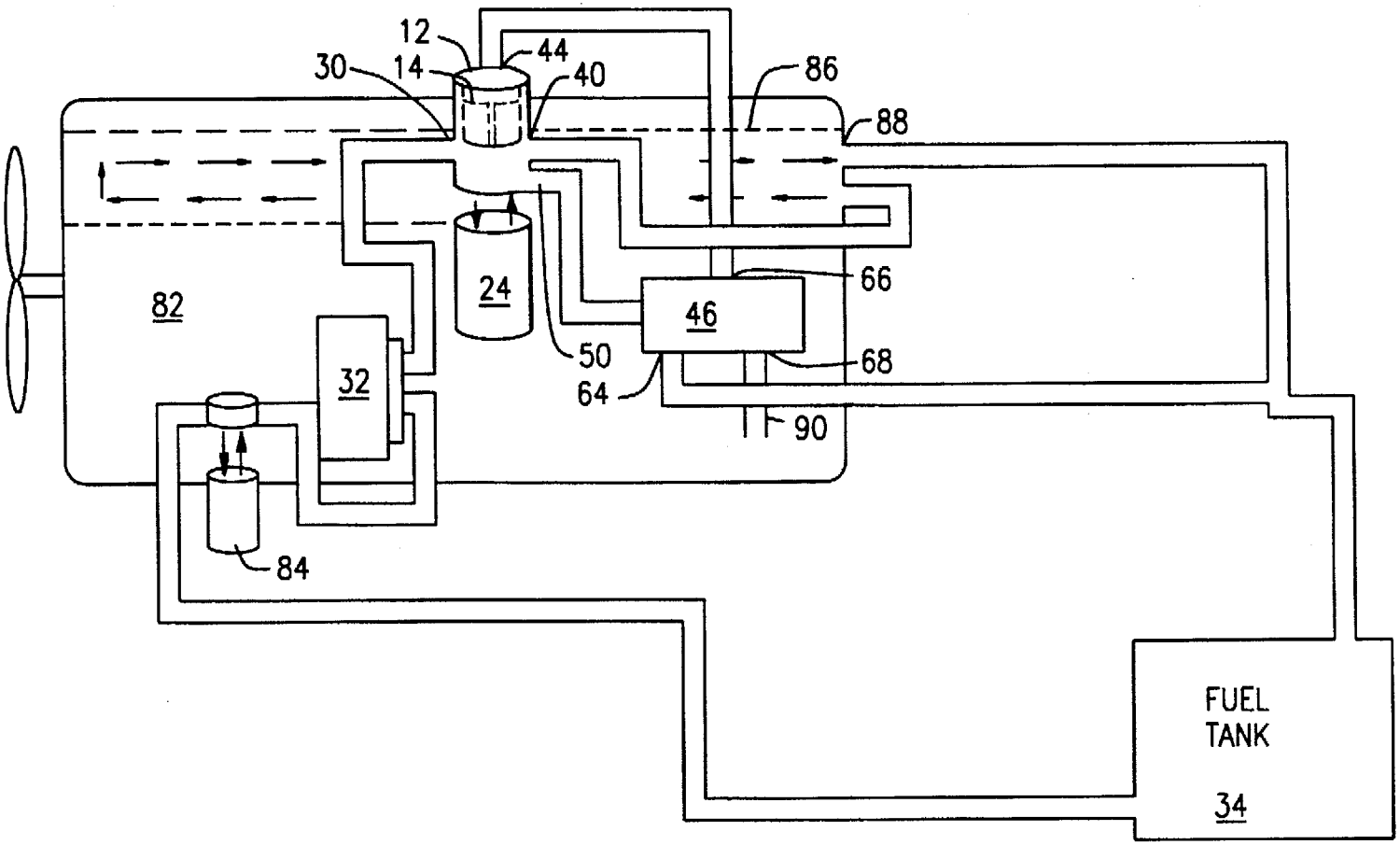
FIG. 3 is a schematic view of fuel/vapor separator in relation to a diesel engine.

As the fuel passes through the upper metal screen element 38, the fuel collects in the bottom of the separation chamber 14. An exit port or output port 40 is disposed in the canister base 18 at the bottom of the separation chamber 14. A second metal screen element 42 is disposed at the bottom of the separation chamber 14 to help separate any foaming of the collected fuel from the liquid fuel at the bottom of the separation chamber 14 during certain operations, as explained below. The exit port 40 is disposed below the second metal screen element 42. The exit port 40 is joined to the fuel injection system or carburetor of the diesel engine, as seen in FIG. 3. As such, the diesel engine is supplied with only liquid fuel, whereas excess air and vapor bubbles have been removed by the process agitation in the separation chamber 14. Since the fuel now contains much less air and vapor bubbles than does ordinary fuel, the fuel burns more evenly and significantly improves the performance of the engine, such as increased gas mileage and power.

As can be seen in FIG. 1, the air and vapor separated from the fuel in the separation chamber 14 passes through a vapor port 44 at the top of the canister 12. The vapor port 44 is coupled to a valving arrangement 46. During normal operation, the valving arrangement 46 couples the vapor port 44 to a return line 48 that leads back to the fuel tank 34. As a result, the vapor is recycled back to the fuel tank 34 where it may condense back into liquid fuel. The schematic of the valving arrangement 46 illustrated in FIG. 1 is shown in an arrangement for a normal engine running scenario, wherein the separated vapor from the separation chamber 14 is returned to the fuel tank 34. A small percentage of diesel fuel may also pass through the vapor port 44 back into the fuel tank 34. The remaining functions of the valving arrangement 46 are for changing the fuel filter cartridge 24 during maintenance when the engine is not running, as will later be explained.

A drain conduit 50 is disposed within the canister base 18. The drain conduit 50 is coupled to the valving arrangement 46 at one end. The opposite end of the drain conduit 50 extends into the supply tube 16. An extension tube 52 couples to the drain conduit 50, thereby effectively extending the drain conduit 50 well into the fuel filter cartridge 24. During maintenance, when it is desired to change the fuel filter cartridge 24, the valving arrangement 46 is configured so that the drain conduit 50 is directly coupled to the return line 48, as explained below.

Figure 2:
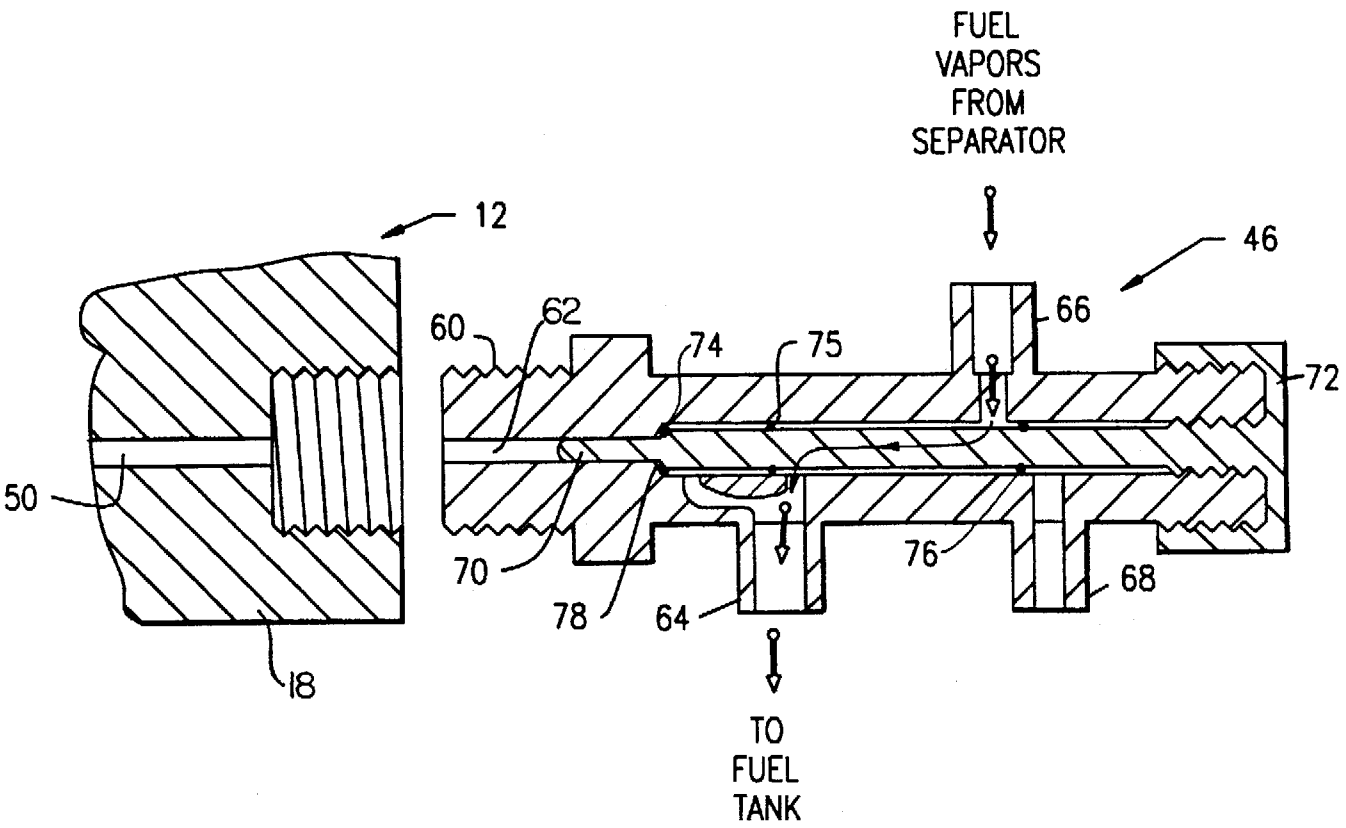
FIG. 2 is sectional view of the valving arrangement in a normal operating position.

Referring to FIG. 2 there is shown one preferred embodiment of the valving arrangement 46. The valving arrangement 46 shown has a threaded end 60 that enables the valving arrangement 46 to be directly coupled to the drain conduit 50 in the base 18 of the canister 12. The valving arrangement 46 has a central conduit 62 that communicates with the drain conduit 50. Three attachment ports 64, 66, and 68 extend into the sides of the valving arrangement 46, wherein each of the attachment ports 64, 66, and 68 communicates with the central conduit 62. The first attachment port 64 is coupled to the fuel return line 48, as seen in FIG. 1, that leads back to the fuel tank. The second attachment port 66 is coupled to the vapor port 44, as seen in FIG. 1, in the top of the canister 12. Lastly, the third attachment port 68 is coupled to an air port that is vented to the ambient atmosphere.

Within the valving arrangement 46 is disposed a control pin 70. The control pin 70 terminates at one end with a threaded cap 72 that threadably engages the end of the valving arrangement 46. As such, by either loosening or tightening the threaded cap 72, the position of the control pin 70 within the central conduit 62 can be selectively altered. The control pin 70 seals with the central conduit 62 by the use of three O-rings 74, 75, 76. By changing the position of the control pin 70 and the O-rings 74, 75, 76 in the central conduit 62, the flow between the various attachment ports 64, 66, and 68 can be controlled.

The control pin 70 has been advanced to its deepest position within the central conduit 62, as shown in FIG. 2. At this position, the first O-ring 74 seals against a lip 78 within the central conduit 62, thereby preventing the flow of fuel from the drain conduit 50 into the central conduit 62. At the shown position, the third attachment port 68, which leads to ambient venting, is also isolated. The configuration shown in FIG. 2 illustrates the position of the valving arrangement 46 when the engine is running. In this circumstance, the second attachment port 66 communicates with the first attachment port 64, thereby attaching the vapor port 44, shown in FIG. 1, to the fuel return line 48 shown in FIG. 1. As a result, vapor passes through the valving arrangement 46 and is recycled to the fuel tank.

A schematic of the fuel/vapor separator device 10 in relation to the diesel engine 82 and the fuel tank 34 is shown in FIG. 3. The fuel pump 32, also referred to as a transfer pump, pulls the fuel from the fuel tank 34 and pass it through a removable primary filter 84 prior to reaching the fuel pump 32. The primary filter 84 removes both water and particles in the fuel.

The fuel is then pumped by the fuel pump 32 to the supply port 30, as seen in FIG. 1, on the canister 12. The fuel passes through the fuel filter cartridge 24, which is capable of removing finer particles than the primary filter 84 and in addition any water not trapped in the primary filter 84. The fuel then enters the separation chamber 14 described above. The fuel that has been de-vapored flows through the exit port 40 to the engine 82. The fuel flows in the engine 82 through the fuel rail or gallery 86, shown in hidden line, with a portion of the fuel being injected into the cylinders to be combusted to generate power. The excess fuel leaves the engine 82 through the fuel return or fuel spill 88 and is returned to the fuel tank 34.

The vapor and fuel which exits the separation chamber 14 through the vapor port 44 flows through the valving arrangement 46 to merge with the excess fuel and return to the fuel tank 34. The valving arrangement 46 is shown removed from the canister 12 for clarity. The drain conduit 50 of the fuel/vapor separator device 10 is shown connected to the valving arrangement 46. The air port 90 is likewise connected to the valving arrangement. It is recognized that diesel engines 82 vary, and the diesel engine 82 may include injectors and an injector pump.

Figure 4:
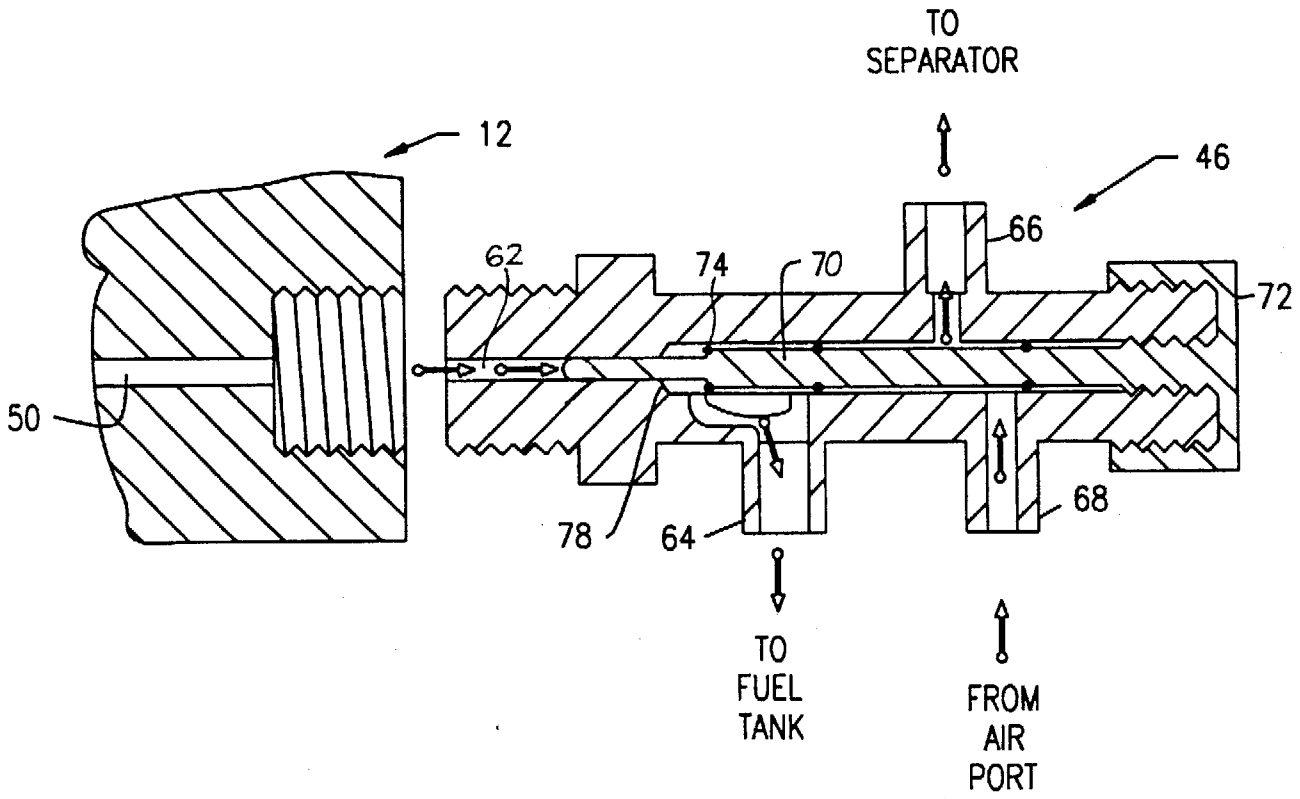
FIG. 4 is a sectional view of the valving arrangement in a fuel filter cartridge draining position.
Figure 5:
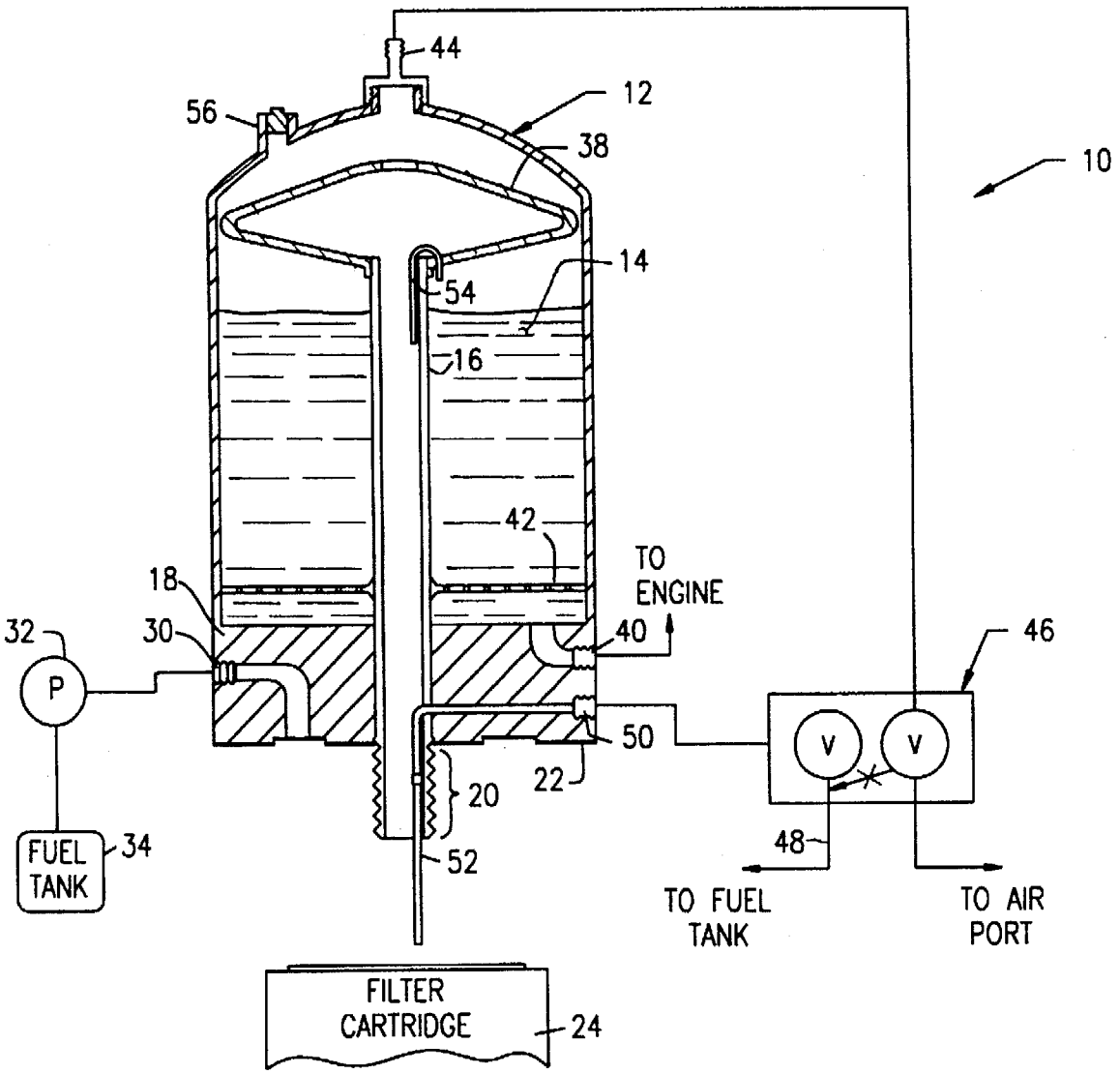
FIG. 5 is a view similar to FIG. 1 in the fuel filter cartridge draining position.

Referring to FIG. 4, the valving arrangement 46 is shown in an orientation for draining the fuel filter cartridge 24, as seen in FIG. 5, prior its replacement. In this orientation, the threaded cap 72 is loosened, thereby retracting the control pin 70 within the central conduit 62. As the control pin 70 retracts, the first O-ring 74 separates from the lip 78 within the central conduit 62. This enables fuel to flow from the drain conduit 50 into the first attachment port 64. As a result, fuel being drained from the canister 12 through the drain conduit 50 is directed back into the fuel tank. Furthermore, when the control pin 70 is positioned into the retracted position shown, the second attachment port 66 is coupled to the third attachment port 68. This enables air to vent through the valving arrangement 46 and into the vapor port 44 of the separator canister 12. The air flows from an air vent, coupled to the third attachment port 66, through the central conduit 62 and out through the second attachment port 66 to the vapor port at the top of the separator canister 12.

Referring to FIG. 5, with the drain conduit 50 coupled to the fuel return line 48, the valving arrangement 46, as seen in FIG. 4, vents the canister 12 by coupling the vapor port 44 to the ambient air. With the top of the canister vented to the ambient atmosphere, the fuel in the supply tube 16 drops into the filter cartridge 24, thereby forcing the fuel in the filter cartridge 24 out through the drain conduit 50. This flow creates a syphon which draws the fuel out of the fuel filter cartridge 24, through the fuel return line 48, and back into the fuel tank 34. The syphon action drains the fuel filter cartridge 24 until the fuel level in the fuel filter cartridge 24 drops below the bottom of the drain conduit extension tube 52. At this point, practically no fuel is left within the fuel filter cartridge 24. This allows the fuel filter cartridge 24 to be replaced without spilling fuel and without loosing any significant amount of fuel in the filter cartridge 24.

Although the syphon action drains the fuel in the supply tube 16 and the fuel filter cartridge 24, the syphon action does not drain the fuel held in the separation chamber 14 below the level of the top of the supply tube 16. As such, the separation chamber 14 remains filled to the level of the top of the supply tube 16 when the fuel filter cartridge 24 is removed. To prevent fuel from splashing into the top of the supply tube 16 when the fuel filter cartridge 24 is removed, a syphon tube 54 is provided that extends over the top edge of the supply tube 16. The syphon tube 54 hooks over the top of the supply tube 16 and extends a short distance below the top of the supply tube 16. As a result, when the supply tube 16 is drained, a syphon is created in the syphon tube 54 that drains the separation chamber 14 to a point well below the level of the top of the supply tube 16. Consequently, the fuel is much less likely to splash through the upper metal screen element 38 and into the supply tube 16 when the fuel filter cartridge 24 is removed.

After the fuel filter cartridge 24 is replaced, it may be desirable, but not necessary, to prime the filter cartridge 24 with fuel in order to ensure the rapid starting of the engine. For such a reason, a priming closure 56 is provided at the top of the canister 12. By pouring fuel into the priming closure 56, the fuel fills the separation chamber 14 and flows into the supply tube 16. As a result, the fuel filter cartridge 24 fills with fuel and the system is primed.

Figure 6:
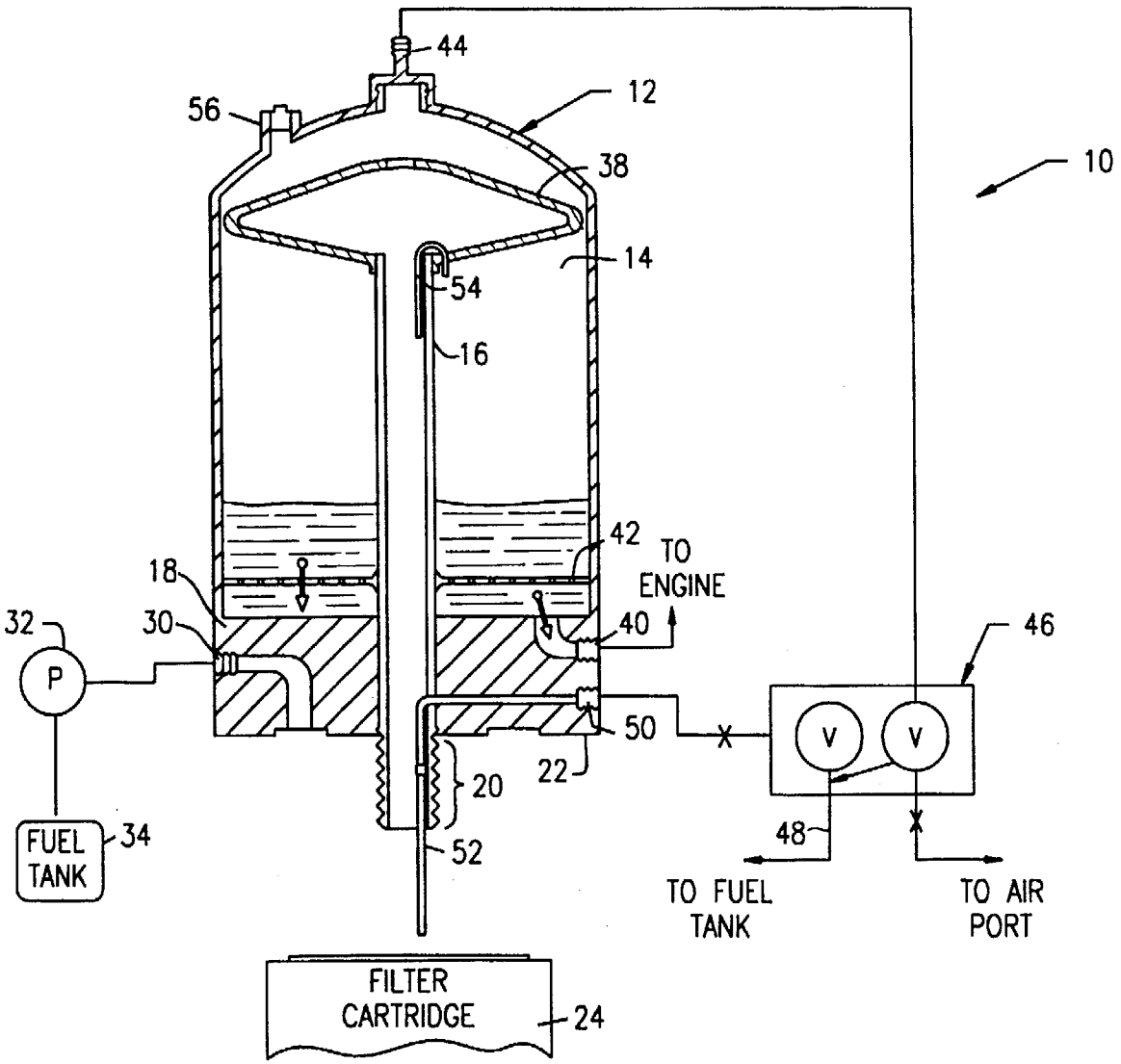
FIG. 6 is a view similar to FIG. 1 in an out-of-fuel condition.

Referring to FIG. 6, if the fuel in the fuel tank 34 falls below a level where the fuel pump 32 can pump fuel into the fuel filter cartridge 24 and up the supply tube 16 in the separation chamber 14, the level of fuel will drop in the separation chamber 14 as the engine 82 receive fuel from the exit port 40. The upper surface of the fuel, which is exposed to the layer of air, will foam. The second metal screen 42 helps to separate any foaming of the collected fuel from the liquid fuel at the bottom of the separation chamber. The exit port 40 is disposed below the second metal screen element 42 and therefore is exposed to only liquid fuel during normal operations.

Upon refilling the fuel tank 34, the fuel pump 32 pumps fuel through the supply port 30 into the fuel filter cartridge 24 and up through the supply tube 16 into the separation chamber 14. The air located in the separation chamber 14 will be vented out through the vapor port 44, making priming unnecessary.

An alternative embodiment of the fuel/vapor separator apparatus 10' is shown in FIG. 7. The fuel/vapor separator apparatus 10' has an upper metal screen element 38' attached to the supply tube 16 near the top of the separation chamber 14'. The relative position of where the screen element 38' is connected to the supply tube 16' is lower, and not directly adjacent to the top of the supply tube 16. Similar to the first embodiment, the metal screen element 38' forms an inner enclosed area 39' bounded by a pair of frustum of cones with the bases joined and the portion directly above the supply tube 16' is solid.

Similar to the first embodiment, the fuel/vapor separator appartus 10' has a syphone tube 54' that extends over the top edge of the supply tube 16'. The syphon tube 54' hooks over the top of the supply tube 16' and extends a short distance below the top of the supply tube 16'. As a result, when the supply tube 16' is drained, a syphon is created in the syphon tube 54' that drains the separation chamber 14 to a point well below the level of the top of the supply tube 16. In contrast to the first embodiment, because of the relatvie position of the screen element 38', the syphon tube 54' does not extend through the screen element 38'. Therefore, it is not possible for even a small amount of fuel to pass through the syphon tube 54' into the separation chamber without passing through the screen element. However, similar to the first embodiment, the fuel is much less likely to splash into the supply tube 16 when the fuel filter cartridge 24 is removed.

Another alterative is that the fuel/vapor separator apparatus 10' has an exit tube 94 connected to an exit port or output port 40'. The exit port 40' is disposed in the canister base 18' at the bottom of the separation chamber 14'. The exit tube 94 has a pair of ports, a main port 96 and an idle port 98, which open into the separation chamber 14'. The ports 96 and 98 allow the fuel to flow from the separation chamber 14' into the exit tube 94 and into the exit port 40'. The main port 96 is located below the second metal screen element 42', but above the idle port 98. The exit tube 94 has a cylindrical top with a vent 100, and a ball float 102 located within the tube 94.

During normal operation, the separation chamber 14' is full with fuel and the ball float 102 floats to the top of the exit tube 94 where the ball float 102 is limited from moving because of the cylindrical top. If the fuel in the fuel tank 34, as seen in FIG. 3, falls below a level where the fuel pump 32 can pump the fuel, the fuel level in the separation chamber 14' will drop as the engine receives fuel from the exit port 40'. As the fuel drops in the separation chamber 14', the ball float 102 drops. The ball float 102 continues to drop until the ball float 102 blocks the main port 96 and reaches an orifice 104 or constriction in the exit tube 94. The orifice 104 prevents the ball float 102 from dropping further. With the main port 96 closed by the ball float 102, the engine is limited to the quantity of fuel that can pass through the idle port 98. This reduction in fuel results in the engine dropping down to an idle speed.

Similar to the first embodiment, the fuel/vapor separator apparatus 10' has a second metal screen element 42' disposed at the bottom of the separation chamber 14 to help separate any foaming of the collected fuel from the liquid fuel at the bottom of the separation chamber 14. The metal screen element 42' is located just above the main port 96.

Figure 7A:
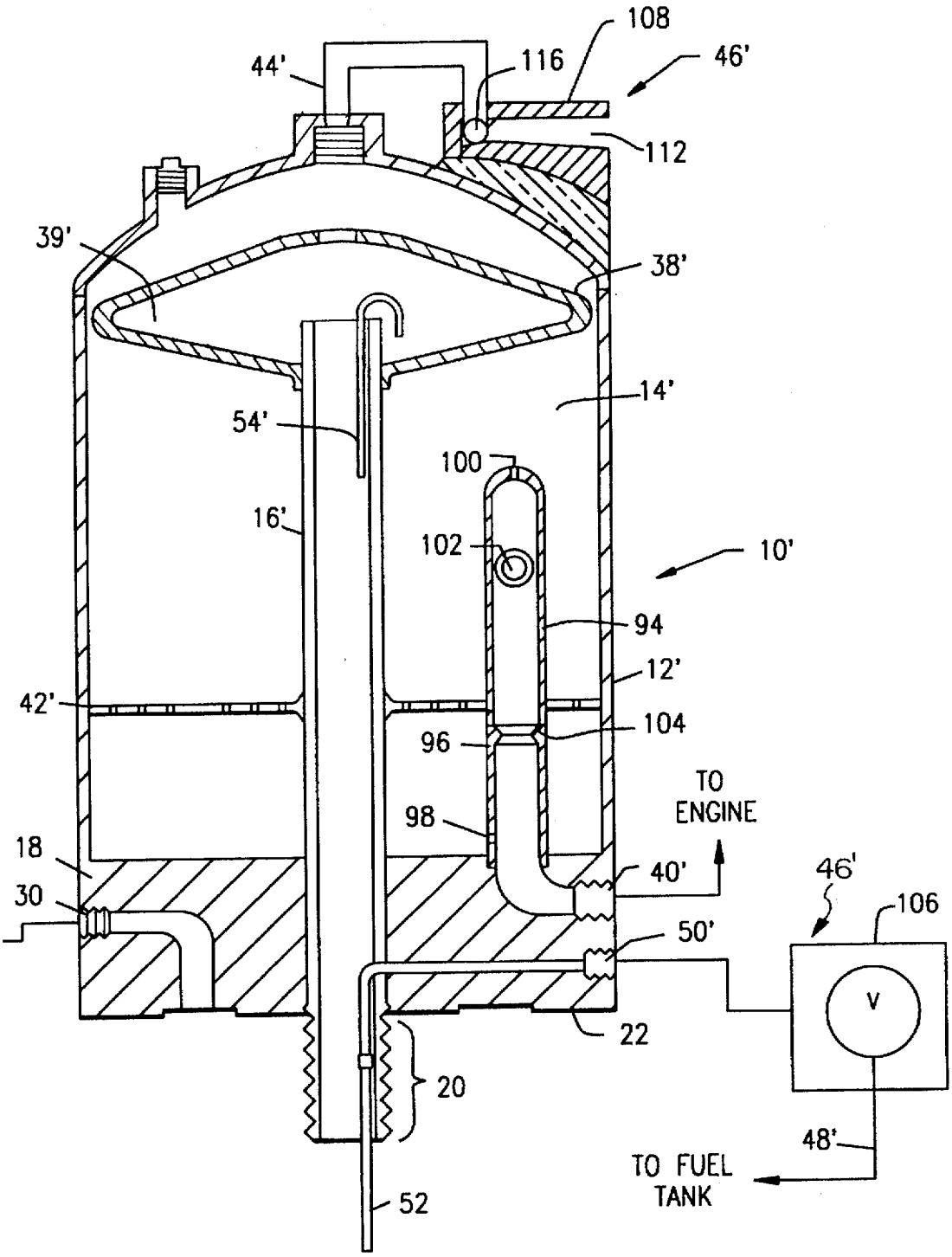
FIGS. 7A and 7B are an alternative embodiment of fuel/vapor separator showing several alternative features.
Figure 7B:
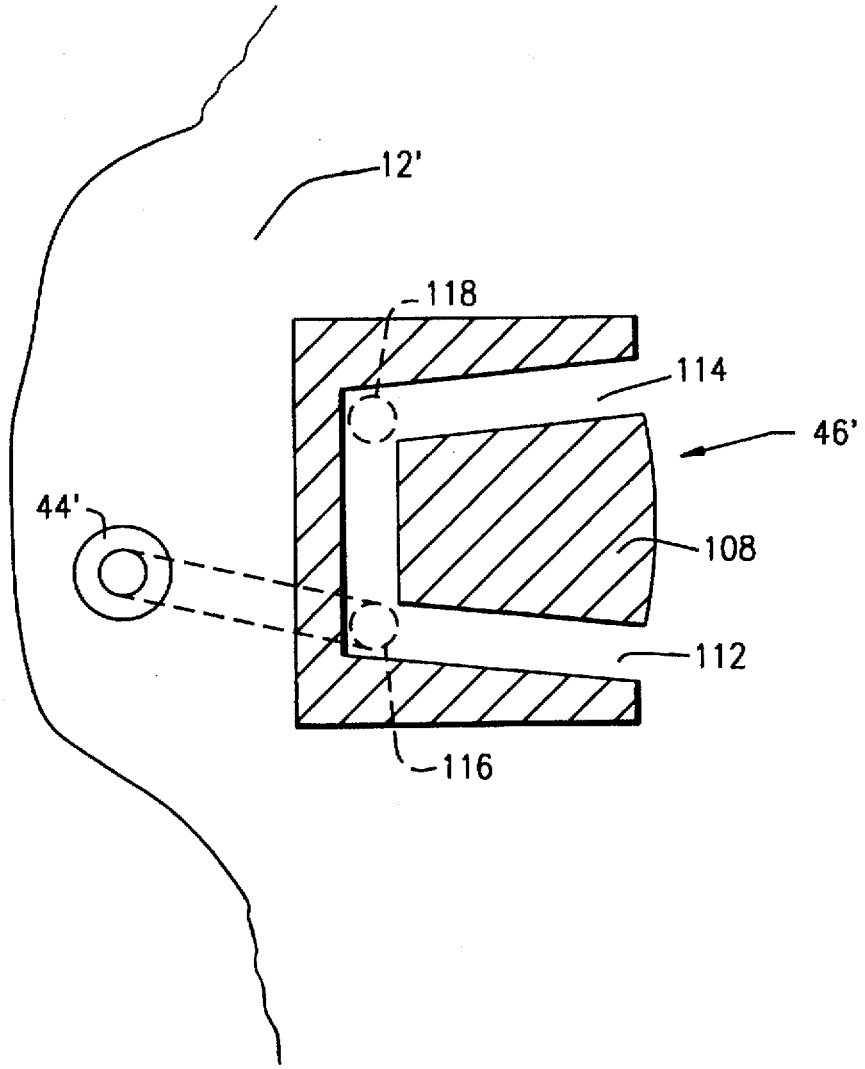

An alternative valving arrangement 46' is shown in FIGS. 7A and 7B. The fuel/vapor separator 10' has a single valve 106 connected to the drain conduit 50'. This valve is typically closed and is open when it is desired to drain the fuel filter cartridge, as seen in FIG. 5. The fuel being drained from the fuel filter cartridge through the drain conduit 50' is directed back into the fuel tank.

In addition, the valving arrangement has a manifold 108 carried by the hollow canister 12'. In the embodiment shown, the manifold 108 is carried at the top of the canister 12' and is spaced by an insulating material 110. The manifold 108 has an input port 112 and an output port 114. The fuel returning from the engine and the fuel return 88, as seen in FIG. 3, enters the input port 112 and the output port 114 and is in communication with the fuel tank 34. The manifold 108 in addition has a vent receiving port 116 through which the vapor and the fuel from the separation chamber 14' that passes through the vapor port 44' is connected to the fuel tank 34. In addition the manifold 108 has a port 118 which is connected to a valve that is coupled to an air port that is vented to the ambient atmosphere. This valve is normally closed.

When it is desired to drain the fuel filter cartridge 24, as seen in FIG. 7A, both valves associated with the valving arrangement 46' are open. The drain conduit 50' is connected to the fuel tank and the vapor port 44' is connected to the ambient air. Similar to the first embodiment, when the top of the canister vented to the ambient atmosphere, the fuel in the supply robe 16' drops into the filter cartridge 24, thereby forcing the fuel in the filter cartridge 24 out through the drain conduit 50'. This flow creates a syphon which draws the fuel out of the fuel filter cartridge 24, through the fuel return line 48 and back into the fuel tank 34. The syphon action drains the fuel filter cartridge 24 until the fuel level in the fuel filter cartridge 24 drops below the bottom of the drain conduit extension tube 52.

One distinction from the first embodiment, is that the return line from the engine is vented to the ambient air also at this point. The fuel tank is normally vented. These valves would not be open when the engine is running and no fuel would be pumped out of the port.

In either embodiment, it is possible to remove and replace the fuel filter cartridge 24 while the engine is running as seen in FIG. 3. In order to remove and replace the fuel filter cartridge 24, the valving arrangement 46 or 46' are not changed from their normal operation position. The primary filter 84 is removed first. In removing the primary filter 84, the fuel pump 32, or transfer pump, can not pull any fuel from the fuel tank 34 since the primary filter 84 is part of the path. The fuel pump 32 pumps air into the fuel filter cartridge 24 therein emptying the fuel into the separation chamber 14. The fuel filter cartridge 24 can then be removed. The separation chamber 14 or 14' acts in an empty fuel tank stage as described above with respect to FIGS. 6 or 7A. When the fuel filter cartridge 24 and primary filter 84 are replaced, the fuel pump 32 refills the filters with fuel and the air that has entered the system is vented through the vapor port 44 or 44'. The system does not need to be primed since the line from the exit port 40 or 40' to the engine always contains fuel.

The present invention may be embodied in other specific forms without departing from the spirit or essential attributes therefore and, accordingly, references should be made to appended claims, rather than to the foregoing specification, as indicating the scope of the invention. For example, the attachment ports 64, 66, 68 on the valving arrangement could be threaded in order to receive a threaded pipe connector. Similarly, numerous other mechanical valving means could be used in place and instead of the valving arrangement described. The operation of such valving means could be mechanical, as is shown, or may be electrically or pneumatically driven.

I claim:

1. A method of replacing a fuel filter cartridge associated with an engine while the engine is running, comprising the following steps:

providing a hollow canister defining a separation chamber having an input port connected to the fuel filter, an output port, and a vapor port;

removing a primary fuel filter located between a fuel tank and a fuel pump;

forcing the fuel out of the fuel filter cartridge through the supply tube by pumping in air;

removing and replacing the fuel filter cartridge; and replacing the primary fuel filter; and pumping fuel from the fuel tank through the primary filter to the and the fuel filter cartridge; and venting the air through the vapor port.

2. A fuel/vapor separator apparatus for de-vaporizing fuel entrained with vapor and returning the vapor to a reservoir, the apparatus comprising;

a canister defining a separation chamber, the canister having an input port for receiving the fuel entrained with vapor, an output port in communication with the engine for removal of the de-vapored fuel from the chamber, and a vapor port for removal of the released vapor from the chamber;

a screen element located in the separation chamber of the canister marginally adjacent to one end thereof, for agitating the fuel to release the vapor from the fuel;

a second screen element located in the separation chamber between the screen element and the output port for limiting any foaming from the output port; and a valving arrangement for connecting the vapor port to the reservoir;

wherein the valving arrangement has at least three ports and the vapor port of the canister is in communication with the first port of the valving arrangement, the reservoir is in communication with the second port of the valving arrangement, and the ambient air is in communication with the third port, and the valving arrangement having a conduit with a control pin for selecting the venting of the separation chamber through the vapor port to either the fuel tank or the ambient air.

3. A fuel/vapor separator apparatus for de-vaporizing fuel entrained with vapor pumped from a fuel tank, the apparatus comprising;

a hollow canister defining a separation chamber having a top and a bottom, the canister having a base with an input port for receiving the fuel entrained with vapor, a supply tube extending through the base and terminating near the top of the separation chamber, wherein the base of the hollow canister has a supply port having a pair of ends, the supply port in communication with a fuel pump at one end and in communication with a fuel filter cartridge at the other end, and the input port of the supply tube of the hollow canister adapted to be engaged by the fuel filter cartridge;

the canister having an output port communicating with the separation chamber in proximity to the bottom of the separation chamber for removal of the de-vapored fuel from the separation chamber;

a screen element located in the separation chamber for agitating the fuel to release the vapor from the fuel;

the canister having a vapor port communicating with the separation chamber generally at the top for removal of the released vapor from the chamber; and a valving arrangement for connecting the vapor port to the fuel tank.

4. A fuel/vapor separator apparatus for separating vapor from fuel entrained with vapor, the apparatus comprising:

a canister defining a single separation chamber, the canister having an input port for receiving the fuel entrained with vapor, an output port for removal of the de-vapored fuel from the separation chamber, and a vapor port for removal of the vapor separated from the fuel, from the separation chamber;

agitation means located in the separation chamber for agitating the fuel to release the vapor from the fuel; and defoaming means located in the separation chamber between the agitation means and the output port for limiting any foaming from the output port.

5. A fuel/vapor separator apparatus as in claim 1 wherein the agitation means is located in the separation chamber marginally adjacent to one end thereof such that generally all of the fuel passes through the agitation means.

6. A fuel/vapor separator apparatus as in claim 4 wherein the agitation means is a screen element for agitating the fuel and breaking the surface tension of the fuel.

7. A fuel/vapor separator apparatus as in claim 6 wherein the defoaming means is a second screen element.

8. A fuel/vapor separator apparatus as in claim 5 further comprising a valving arrangement for selecting the venting of the separation chamber through the vapor port to either a fuel tank or the atmosphere.

9. A fuel/vapor separator apparatus for de-vaporizing fuel entrained with vapor and returning the vapor to a reservoir, the apparatus comprising;

a canister defining a single separation chamber, the canister having an input port for receiving the fuel entrained with vapor, an output port in communication with the engine for removal of the de-vapored fuel from the chamber, and a vapor port for removal of the released vapor from the chamber;

a screen element located in the separation chamber of the canister marginally adjacent to one end thereof, for agitating the fuel to release the vapor from the fuel;

a second screen element located in the separation chamber between the screen element and the output port for limiting any foaming from the output port; and a valving arrangement for connecting the vapor port to the reservoir.

10. A fuel/vapor separator apparatus for de-vaporizing fuel entrained with vapor pumped from a fuel tank, the apparatus comprising:

a hollow canister defining a single separation chamber having a top and a bottom, the canister having a base with an input port for receiving the fuel entrained with vapor, a supply tube extending through the base into the separation chamber and terminating near the top thereof, said supply tube delivering the fuel received by the input port to the separation chamber near the top thereof;

the canister having an output port communicating with the separation chamber in proximity to the bottom of the separation chamber for removal of the de-vapored fuel from the separation chamber;

a screen element located in the separation chamber of the canister near the top thereof, for agitating the fuel to release the vapor from the fuel:

the canister having a vapor port communicating with the separation chamber generally at the top for removal of the released vapor from the chamber; and a valving arrangement for connecting the vapor port to the fuel tank, wherein the base of the hollow canister has a supply port having a pair of ends, the support port in communication with a fuel pump at one end and in communication with a fuel filter cartridge at the other end, and the input port of the supply tube of the hollow canister adapted to be engaged by the fuel filter cartridge.

11. A fuel/vapor separator apparatus as in claim 10, wherein the base of the hollow canister has a drain conduit having a pair of ends, one of the ends extending through the supply tube into the fuel filter cartridge and the other end adapted to communicate with the valving arrangement.

12. A fuel/vapor separator apparatus as in claim 11, wherein the valving arrangement has a quadruplet of ports, the first port in communication with the vapor port of the canister, the second port in communication with the fuel tank, the third port in communication with the drain conduit, and the fourth port in communication with the ambient air, the valving arrangement having a conduit with a control pin for selecting the venting of the separation chamber through the vapor port to either the fuel tank or the ambient air, and selectably connecting the drain conduit to the fuel tank.

13. A fuel/vapor separator apparatus as in claim 12, wherein the hollow canister has a priming closure opening into the separation chamber, and a second screen element located in the separation chamber between the screen element and the output port for limiting any foaming from the output port.

14. A fuel/vapor separator apparatus as in claim 11, further comprising a syphon tube projecting upward from the supply tube over the top of the supply tube and extending below the top of the supply tube.

15. A fuel/vapor separator apparatus as in claim 14, wherein the syphon tube extends through the screen element.

16. A fuel/vapor separator apparatus as in claim 14, wherein the screen element defines an inner enclosed area within the separation chamber and the syphon tube is located in the supply tube and the inner enclosed area.

17. A fuel/vapor separator apparatus as in claim 9, further comprising an exit tube connected to the output port, the exit tube having a main port and an idle port which open into the separation chamber, the exit tube having a top, and a float located within the tube for blocking the main port when the fuel is at a specific level.

18. A method of removing vapor from fuel comprising the following steps:

providing a hollow canister defining a single separation chamber having an input port, an output port, and a vapor port;

passing fuel into the separation chamber through the input port;

passing the fuel through a screen element for agitating and breaking the surface tension of the fuel and resulting in;

releasing vapor entrained in the fuel;

collecting the de-vapored fuel in a bottom of the separation chamber;

passing the de-vapored fuel through a second screen element after the first screen element for limiting foaming in the de-vapored fuel passing from the separation chamber;

passing the de-vapored fuel from the separation chamber through the output port; and venting the released vapor from the separation chamber through the vapor port.

19. A method of removing vapor from fuel as in claim 18 further comprising the step of returning the venting released vapor to a reservoir.

20. A method of removing vapor from fuel as in claim 19 further comprising the following steps:

pumping the fuel from the reservoir; and filtering the fuel through a fuel filter cartridge prior to passing the fuel into the separation chamber through the input port.

21. A method of replacing a fuel filter cartridge comprising the following steps:

providing a hollow canister defining a separation chamber having an input port connected to the fuel filter, an output port, and a vapor port;

configuring a valving arrangement for connecting a drain conduit, which extends into the fuel filter, to a return line to a resevoir, and for connecting the vapor port to ambient air;

forcing the fuel out of the fuel filter cartridge through the drain conduit by dropping the fuel in a supply tube connected to the input port of the hollow canister, therein creating a syphon;

removing and replacing the fuel filter cartridge; and reconfiguring the valving arrangement for connecting the vapor port to the return line to the resevoir and closing the drain conduit and the port to ambient air.

22. A method of replacing a fuel filter cartridge as in claim 21 further comprising the step of draining the fuel in the separation chamber of the hollow canister to a specific level below the top of the supply tube.

* * * * *